US006692328B1

(12) United States Patent
Reinberg et al.

(10) Patent No.: US 6,692,328 B1
(45) Date of Patent: Feb. 17, 2004

(54) ELECTRONIC TOY USING PRERECORDED MESSAGES

(75) Inventors: Alan R. Reinberg, Boise, ID (US); Graham R. Wolstenholme, Boise, ID (US)

(73) Assignee: Micron Technology, Inc., Boise, ID (US)

( * ) Notice: Subject to any disclaimer, the term of this patent is extended or adjusted under 35 U.S.C. 154(b) by 916 days.

(21) Appl. No.: 08/824,110

(22) Filed: Mar. 25, 1997

(51) Int. Cl.[7] ..... A63H 33/30
(52) U.S. Cl. ..... 446/142; 446/141
(58) Field of Search ..... 446/303, 302, 446/301, 142, 456

(56) References Cited

U.S. PATENT DOCUMENTS 4,104,821 A * 8/1978 Nakajima ..... 446/142
4,777,938 A * 10/1988 Sirota ..... 446/301 X
4,857,030 A * 8/1989 Rose ..... 446/303
4,973,285 A 11/1990 Diotte
5,183,431 A 2/1993 Todokoro
5,184,971 A 2/1993 Williams
5,609,508 A * 3/1997 Wingate ..... 446/142
5,646,593 A * 7/1997 Hughes et al. ..... 340/573

* cited by examiner

*Primary Examiner*—Derris H. Banks
*Assistant Examiner*—Dmitry Suhol
(74) *Attorney, Agent, or Firm*—Fletcher Yoder

(57) ABSTRACT

A toy, such as a toy pager or a toy telephone, generates an attention signal and plays a recorded message to the user. The attention signal is generated in a seemingly random fashion to simulate the operation of a real pager or telephone.

15 Claims, 2 Drawing Sheets

ELECTRONIC TOY USING PRERECORDED MESSAGES

BACKGROUND OF THE INVENTION

1. Field of the Invention

The present invention relates generally to toys and, more particularly, to electronic toy telephones and pagers that realistically simulate receiving messages.

2. Description of the Related Art

As most of society is well aware, children like to emulate their role models, which are typically adults. For instance, children like to pretend that they are adults. As a result, for many, many years, toy manufacturers have produced children's versions of adult products. By way of example, many children have grown up playing with toy lawn mowers that make clicking or motorized sounds when they are pushed. In fact, the list of toys that emulate adult products includes toy cars, boats, motorcycles, stoves, houses, guns, radios, cameras, and computers, just to name a few.

When designing these types of toys, toy manufacturers focus on attributes of the adult product that are attractive to children of a particular age. For instance, a one year old child may simply be attracted to the color, sound, or feel of a particular adult product. Accordingly, a toy designed for a one year old typically focuses on these attributes instead of the more complicated functionality of the particular adult product. Similarly, older children typically enjoy more complicated toys. However, these toys cannot be identical to the adult product for a variety of reasons. For instance, a toy that simulates an adult product too closely might be too complex for children to use properly. Also, the cost and ruggedness, of a toy must usually be taken into consideration.

In the fast paced world that we currently live in, adults are using cellular telephones and pagers more and more frequently. As for the toy telephones that exist, many succeed in imitating the general appearance of a telephone. Typically, however, toy telephones poorly imitate the manner in which an actual telephone operates. Some toy telephones make ringing noises when buttons on the toy are pushed. While these toy telephones simulate the sounds made by an actual operating telephone, they rely on activation by the user to trigger such sounds. Thus, they do not simulate the way telephone calls are received without prompting by the user, nor do they simulate the unpredictable time periods between incoming calls.

The same can also be said of the toy pagers that exist. Although many toy pagers succeed in imitating the general appearance of a real pager, toy pagers poorly imitate the manner in which an actual pager operates. Some toy pagers make beeping noises when buttons on the toy are pushed. While these toy pagers simulate the sounds made by an actual operating pager, they rely on activation by the user to trigger such sounds. Thus, they do not simulate the way pages are received without prompting by the user, nor do they simulate the unpredictable time periods between incoming pages.

The present invention is directed to overcoming, or at least reducing the effects of, one or more of the problems set forth above.

SUMMARY OF THE INVENTION

In accordance with one aspect of the present invention, there is provided a toy that includes a message timer, a message selector, and a display. The message timer generates a timing signal. The message selector stores a plurality of messages. The display displays one of the plurality of messages in response to receiving the timing signal.

In accordance with another aspect of the present invention, there is provided a toy that includes a clock circuit for generating a clock signal. A random number generator generates a first random number and a second random number. The scaler receives the first random number and generates a timing signal. A counter receives the clock signal and generates a count signal. A comparator generates a first trigger signal in response to the timing signal and the count signal being equal. A display receives the first trigger signal and generates an attention signal. A switch generates a second trigger signal that ceases generation of the attention signal. A message selector stores a plurality of messages. The message selector selects one of the plurality of messages in response to the second random number. The message selector delivers the selected message to the display in response to coincidence of the first trigger signal and second trigger signal.

In accordance with a further aspect of the present invention, there is provided a toy pager. The toy pager includes a visual display and a transducer. A message timer delivers a first trigger signal to the transducer, which generates an attention signal. The play switch is actuatable to generate a second trigger signal. A message selector has a memory for storing a message. The message selector delivers the message to the visual display in response to the second trigger signal.

In accordance with yet another aspect of the present invention, there is provided a toy telephone. The toy telephone includes a speaker and a ringer. The message timer delivers a first trigger signal to the ringer, which generates an attention signal. A switch is actuatable to generate a second trigger signal. A message selector has a memory for storing a message. The message selector delivers the message to the speaker in response to the second trigger signal.

In accordance with still another aspect of the present invention there is provided a toy that includes: means for generating a timing signal, means for storing a message, and means for displaying the message in response to the timing signal.

In accordance with a still further aspect of the present invention, there is provided a toy that includes: means for generating a timing signal, means for storing a message, means for generating an attention signal in response to the timing signal, means for selecting the message in response to the attention signal, and a means for displaying the message.

In accordance with a yet further aspect of the present invention, there is provided a method for operating a toy. The method includes the steps of: generating a timing signal, storing a message, generating an attention signal in response to the timing signal, selecting the message in response to the attention signal, and displaying the message.

In accordance with another aspect of the present invention there is provided a toy that includes: means for generating a random timing signal, means for storing a message, and means for displaying the message in response to the timing signal.

In accordance with a further aspect of the present invention, there is provided a method for operating a toy. The method includes the steps of: generating a random timing signal, storing a message, generating an attention signal in response to the timing signal, selecting the message in response to the attention signal, and displaying the message.

BRIEF DESCRIPTION OF THE DRAWINGS

The foregoing and other advantages of the invention will become apparent upon reading the following detailed description and upon reference to the drawings in which.

Figure 3:
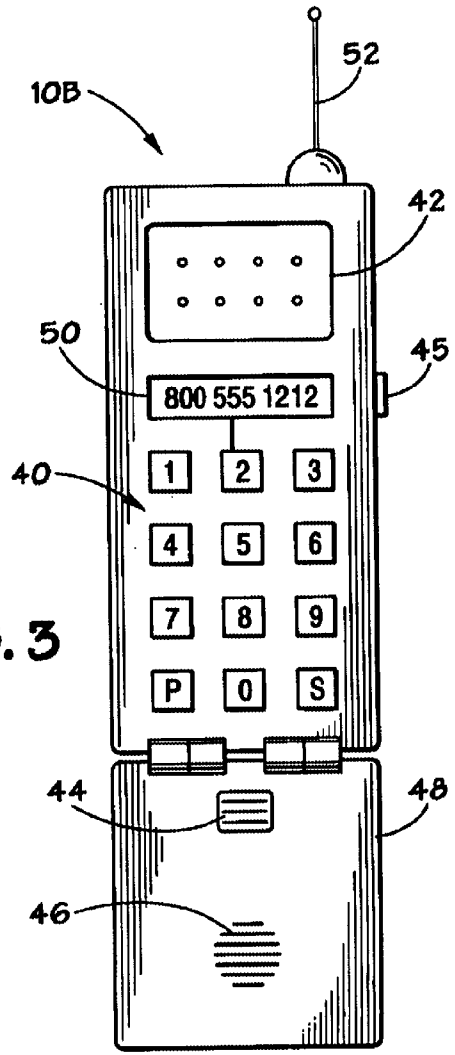
FIG. 3 illustrates on possible external view of a toy telephone.

While the invention is susceptible to various modifications and alternative forms, specific embodiments have been shown by way of example in the drawings and will be described in detail herein. However, it should be understood that the invention is not intended to be limited to the particular forms disclosed. Rather, the invention is to cover all modifications, equivalents and alternatives falling within the spirit and scope of the invention as defined by the appended claims.

DESCRIPTION OF SPECIFIC EMBODIMENTS

Figure 1:
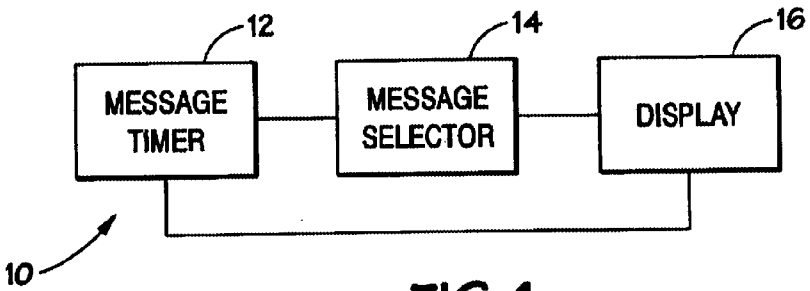
FIG. 1 illustrates a general block diagram of a toy telephone or toy pager.

Turning now to the drawings, and referring initially to FIG. 1, a toy is diagramatically illustrated and generally designated by a reference numeral 10. The toy 10 is designed to display a message to a user automatically. Since the user is typically a child, the type of message and the manner in which the message is displayed may vary depending upon the target age of children who would be interested in playing with the toy 10.

The toy 10 includes a message timer 12 that generally determines when a message is to be displayed. The message timer 12 may take a number of different forms, depending upon the type of timing scheme desired. For instance, the message timer 12 may include a very simple time keeping circuit that delivers a trigger signal at regular intervals. However, the actual device that the toy 10 is emulating may not operate at regular intervals, such as in the case of a toy pager or a toy telephone. In such a case, the message timer 12 may be designed to generate a trigger signal at irregular intervals or random intervals. To produce signals at irregular intervals, the message timer 12 may produce a trigger signal at different preselected time intervals. To produce a trigger signal at random intervals, the message timer 12 may include a random number generator or other suitable means.

The toy 10 of FIG. 1 also advantageously includes a message selector 14. Although the message selector 14 may contain only a single message, the toy 10 more accurately simulates the operation of an actual pager or an actual telephone if it displays a plurality of different messages. Hence, the message selector 14 includes a memory that advantageously stores a plurality of messages that may be selected for display to the user. The stored messages in the message selector 14 may be played in a desired order, or, to create a more realistic toy 10, the messages may be played in a seemingly random order. Advantageously, the message selector 14 stores messages in digital format to facilitate random access to such messages.

The toy 10 also includes a display 16. The display 16 may take a number of forms depending upon the type of toy desired to be emulated and upon the functional complexity desired to be provided for the toy. For instance, the display 16 may include an audio display, a visual display, or a variety of other suitable displays. By way of specific example, the operation and aesthetic design of a toy pager 10A and a toy cellular telephone 10B is described below.

Figure 2:
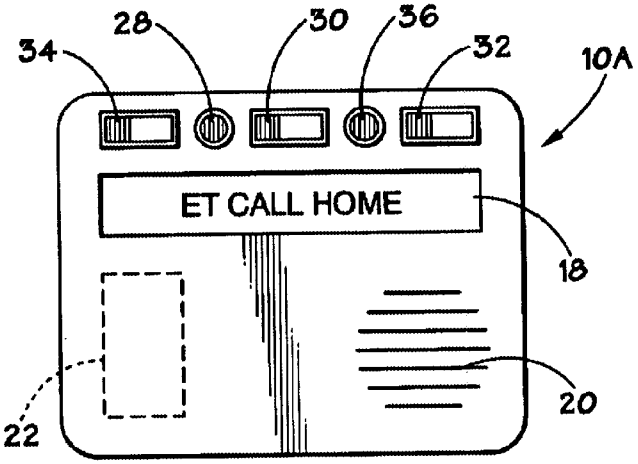
FIG. 2 illustrates one possible external view of a toy pager.

The toy 10 may take the form of a toy pager 10A, as illustrated in FIG. 2. Real pagers typically include a visual display that displays an alphanumeric message to the user. Many real pagers also include a small beeper or speaker that emits a noise to indicate the arrival of a message. Also, many real pagers include a vibrator or buzzer that vibrates the pager to indicate the arrival of a message. Accordingly, in one embodiment, the display 16 of the toy pager 10A may include a visual display 18, a beeper or speaker 20, and a vibrator 22. It is intended that the toy 10 be battery powered. Accordingly, the toy 10 advantageously also includes an on/off switch 34.

To simulate the arrival of a message to the toy pager 10A, the speaker 20 may receive a trigger signal from the message timer 12 or the message selector 14 to trigger the speaker 20 to emit a beep or some other sound or attention signal. The toy pager 10A may also include a vibrator 22 that is activated upon receipt of a trigger signal from the message timer 12 or the message selector 14 to simulate the arrival of a message. If both the speaker 20 and the vibrator 22 are provided on the toy pager 10A, a vibrator/beeper switch 30 may be provided to allow the user to select between an audible beep or an inaudible vibration to signal the arrival of a message.

To view the message, the user of toy pager 10A actuates a play button 36. Although the speaker 20 or the vibrator 22 signals the arrival of an incoming message, the message is not displayed on the visual display 18 until triggered by the actuation of the play button 36. The visual display 18 is advantageously an LCD display. It may display a message having length that can be wholly contained on the visual display 18, or it may be designed to scroll the message across the visual display 18 to permit the display of longer messages.

The speaker 20 may also receive a stored audio message from the message selector 14. It is contemplated that this audio message, as compared to the beep, would be an interesting sound or a voice message. The voice message is advantageously permanently recorded within the message selector 14 using read only memory.

A manual message retrieve button 28 may also be provided on the toy pager 10A. Actuation of the manual message retrieve button 28 causes a message to be retrieved and played on the visual display 18. Actuation of the manual message retrieve button 28 may also cause a signal to be emitted from the speaker 20 or the vibrator 22, depending upon the location of the vibrator/beeper switch 30.

The toy 10 may also include an interval/mode select switch 32. The interval/mode select switch 32 may be used to vary the interval at which messages are automatically played and/or to select a different mode. Actuation of the interval/mode select switch 32 may also cause the interval or mode of the toy 10 to be displayed on the display 18. For example, the toy 10 may be switchable between regular intervals and random intervals. Accordingly, the display 18 may display the word "regular" or "random" to indicate the current mode of the toy 10. Alternatively, actuation of the interval/mode select switch 32 may cause a beep or a preselected series of beeps to be played through the speaker 20 to indicate selection of a different mode.

The toy 10 may also be embodied as a toy telephone 10B, as illustrated in FIG. 3. In this embodiment, the toy telephone 10B includes a numeric keypad 40, a speaker 42, and a microphone 44. The toy telephone 10B also includes an internal ringer 46. Advantageously, the toy telephone 10B simulates a cellular telephone that has a flip-down portion 48 that may house the microphone 44. A switch (not shown in FIG. 3) changes state when the flip-down portion 48 is moved from its closed position covering the keypad 40 to its open position exposing the microphone 44.

To simulate the receipt of an incoming call, the message timer 12 delivers a trigger signal to the ringer 46. The ringer 46 emits a ringing sound to indicate the arrival of the incoming call. Advantageously, in the event that a child leaves the toy telephone 10B on, the ringer 46 emits only a predetermined of number of rings, or it rings for a predetermined time, before the message timer 12 resets. To answer a call, a child opens the flip-down portion 48. The switch (FIG. 4) associated with the flip-down portion 48 changes states to indicate that the user has "answered" the call, and the ringer 46 ceases to ring.

When the opening of the flip-down portion 48 coincides with the simulated arrival of an incoming call, i.e., the delivery of the trigger signal, the change in state of the switch also triggers the delivery of an audio message over the speaker 42. As with the toy pager 10A, the message selector 14 may playback one of a plurality of messages stored in the message selector 14. As described below, it may be advantageous to divide the stored messages into at least two subsets. The first subset may correspond to messages simulating incoming calls, and the second subset may correspond to messages simulating outgoing calls. Thus, when a user "answers" the toy telephone 10B when it rings, a message from the first subset is selected and played back to the user.

The microphone 44 of the toy telephone 10B may be functional to allow a user to record one or more audio messages into the message selector 14 for playback over the speaker 42. Alternatively, as with the toy pager 10A, the message selector 14 of the toy telephone 10B may include one or more messages prerecorded by the manufacturer. In this event, the microphone 44 may be non-functional and placed on the toy telephone 10B for aesthetic purposes only.

For the user to record a message, the user speaks into the microphone 44. The user may initiate the recording of a message by pushing the record button 45. In the event that the toy 10 is capable of having a user record a voice message for later playback, a number of different circuits are known that may be used to accomplish this function. For instance, circuits of this type typically include an analog-to-digital converter that samples the user's voice and converts it into a digital format. The digitized voice samples are typically stored sequentially in random access memory. Oftentimes, such circuits use adaptive delta modulation to facilitate the efficient sampling and storage of such voice messages. When the playback of a stored message is desired, such circuits typically read the contents of the random access memory sequentially and deliver such contents to a digital-to-analog converter, the output of which is coupled to a speaker.

Of course, the addition of the capability of a user to record messages on the toy 10 would likely add cost and complexity to the toy 10. Accordingly, it is advantageous for the message selector 14 to include a read-only memory containing messages recorded during the manufacture of the toy 10.

The toy telephone 10B may also include a digital display 50, which may be similar to the visual display 18 described previously with respect to the toy pager 10A. If the toy telephone 10B includes the digital display 50, the numeric keypad 40 may be functional to simulate the placing of calls. As part of this simulation, the selection of a 7 or 10 digit number, or the actuation of a particular key, such as a "send" key S, may generate a trigger signal. This trigger signal may be delivered to the message selector 14 to initiate the playback of a message over the speaker 42 to simulate a party answering the call placed by the user of the toy telephone 10B. This message may be any one of the messages stored within the message selector 14, it may be a particular message stored in the message selector 14, or it may be selected from the second subset of the messages stored in the message selector 14. The trigger signal generated by the keypad 40 may also be delivered to the message timer 12 to reset it.

The keypad 40 advantageously includes certain functional buttons, such as an on/off button and an interval/mode select button, as previously described with respect to the toy pager 10A. Alternatively, the toy telephone 10B may include an antenna 52 that functions as an on/off switch. When the antenna 52 is in its raised position, the toy telephone 10B is on, and when the antenna 52 is in its retracted position, the toy telephone 10B is off.

Figure 4:
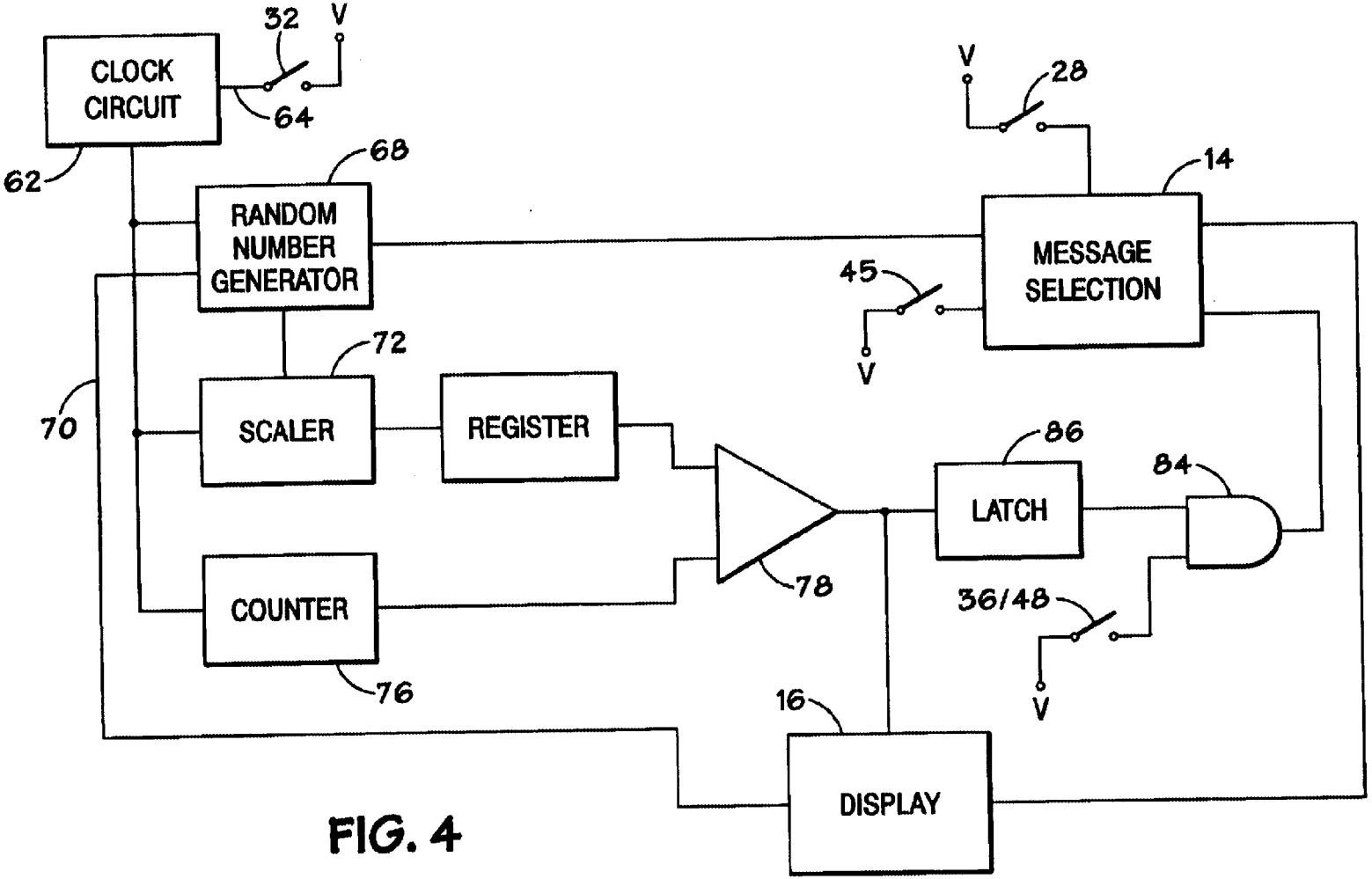
FIG. 4 is a diagramatic illustration of one embodiment of a toy telephone or toy pager.

FIG. 4 illustrates a circuit 60 that may be used with the toy 10, such as the toy pager 10A or the toy telephone 10B. The circuit 60 includes a clock circuit 62 that may generate timing or trigger signals. The clock circuit 62 may generate timing or trigger signals at regular or irregular intervals. In fact, the clock circuit 62 may have different modes that may be selected by the user by actuating the interval/mode select key that delivers a signal to the clock circuit 62 on line 64. For instance, the clock circuit 62 may have the capability of generating trigger signals at three different regular intervals, such as every 40 minutes, every 60 minutes, and every 80 minutes. Also, the clock circuit 62 may deliver a trigger signal directly to the message selector 14 or to the display 16 to trigger playback of a message.

Advantageously, however, a trigger signal is delivered to a random number generator 68. The trigger signal may be generated by the clock circuit 62, by one or more of the switches 28, 34, or 36, or by another suitable source (such as the comparator 78 or AND gate 84 described below). The random number generator 68 may be used to generate a trigger signal over line 70 to the display 16 at some seemingly random time after receiving the trigger signal from the clock circuit 62. However, it may also be desirable to trigger the display 16 at a random time that falls within a particular distribution around an average display time. In this instance, the random number generator 62 generates a first random number that is delivered to a scaler 72. The scaler 72 scales the value of the first random number to the number of clock signals generated by the clock circuit 62 in a nominal time interval. The first random number is generated in such a manner so that it is chosen to give a normal distribution about the value corresponding to the number of clock signals generated in the nominal time. For example, if the nominal time is ten minutes, and the clock rate is 100 cycles per second, then the random number would be scaled to a normal distribution centered about 60,000. The width of the distribution, e.g., the standard deviation, may be a user adjusted value or one built into the scaler 72 at a certain percentage of the peak, such as 10 percent.

The random number produced by the scaler 72 is stored in a register 74. A counter 76 accumulates clock signals from the clock circuit 62. A comparator 78 compares the number of accumulated signals stored in the counter 76 with the random number stored in the register 74. When the two values are equal, the comparator 78 delivers a trigger signal to the display 16.

The random number generator 68 also generates a second random number at about the same time that it generates the first random number. The random number generator 68 delivers the second random number to the message selector 14. The message selector 14 uses this second random number to select one of a plurality of messages stored therein. However, the message selector 14 does not play the message selected by the second random number until it receives a trigger signal. The trigger signal may come from the comparator 78 or it may come from another source. For instance, the trigger signal from the comparator 78 may be sent directly to the display 16 to initiate a beep from the toy pager 10A or a ring from the toy telephone 10B. When the user of the toy pager 10A pushes the play button 36, or when the user of the toy telephone 10B opens the flip-down portion 48, the signal from one of these switches is sent to an AND gate 84. The AND gate 84 also receives the trigger signal from the comparator 78, which is temporarily stored in a latch 86. Thus, if the circuit 60 has initiated the generation of a message for the toy 10 by delivering the trigger signal, and the user of the toy 10 has acknowledged the message by pressing the play button 36 or by opening the flip-down portion 48, the AND gate 84 delivers a trigger signal to the message selector 14. In response to receiving this trigger signal, the message selector 14 accesses the message selected by the second random number and delivers the selected message to the display 16.

What is claimed is:

1. A toy comprising:

a message timer, said message timer generating a random timing signal;

a message selector operatively coupled to the message timer, said message selector storing a plurality of messages; and a display operatively coupled to the message timer and the message selector, said display displaying one of said plurality of messages in response to receiving said timing signal.

2. The toy, as set forth in claim 1, wherein said message timer generates a first random signal and a second random signal, said display receiving said first random signal and generating an attention signal in response thereto, and said message selector receiving said second random signal and selecting one of said plurality of messages in response thereto.

3. A toy comprising:

a clock circuit, said clock circuit generating a clock signal;

a random number generator generating a first random number and a second random number;

a scaler operatively coupled to the random number generator for receiving said first random number, said scaler generating a timing signal correlative to said first random number;

a counter operatively coupled to the clock circuit for receiving said clock signal, the counter generating a count signal correlative thereto;

a comparator operatively coupled to the scaler and the counter receiving said timing signal and said count signal and generating a first trigger signal in response to said timing signal and said count signal being equal;

a display operatively coupled to the comparator for receiving said first trigger signal, the display generating an attention signal in response thereto;

a switch generating a second trigger signal, said second trigger signal ceasing generation of said attention signal; and a message selector storing a plurality of messages, said message selector operatively coupled to the random number generator, the comparator, and the switch for receiving said second random number, said first trigger signal, and said second trigger signal, said message selector selecting one of said plurality of messages in response to said second random number, and said message selector delivering said selected one of said plurality of messages to said display in response to coincidence of said first trigger signal and said second trigger signal.

4. A toy pager comprising:

a visual display;

a transducer;

a message timer operatively coupled to the transducer, said message timer delivering a first trigger signal to said transducer, wherein said transducer generates an attention signal in response to said first trigger signal;

a play switch, said play switch being actuatable to generate a second trigger signal; and a message selector operatively coupled to the play switch and to the visual display, said message selector having a memory for storing a message, said message selector delivering said message to said visual display in response to said second trigger signal.

5. The toy pager, as set forth in claim 4, wherein said visual display comprises a liquid crystal display.

6. The toy pager, as set forth in claim 4, wherein said transducer comprises a beeper that generates an audible attention signal.

7. The toy pager, as set forth in claim 4, wherein said transducer comprises a vibrator that generates a vibrating attention signal.

8. The toy pager, as set forth in claim 4, wherein said message timer comprises:

a clock circuit, said clock circuit generating a clock signal;

a random number generator generating a first random number and a second random number;

a scaler receiving said first random number, said scaler generating a timing signal correlative to said first random number;

a counter receiving said clock signal and generating a count signal correlative thereto; and a comparator receiving said timing signal and said count signal and generating said first trigger signal in response to said timing signal and said count signal being equal.

9. The toy pager, as set forth in claim 8, wherein said message selector stores a plurality of messages and receives said second random number, said first trigger signal, and said second trigger signal, said message selector selecting one of said plurality of messages in response to said second random number, and said message selector delivering said selected one of said plurality of messages to said display in response to coincidence of said first trigger signal and said second trigger signal.

10. A toy telephone comprising:

a handset having a speaker therein;

a ringer;

a message timer operatively coupled to the ringer, said message timer delivering a first trigger signal to said ringer, wherein said ringer generates an attention signal in response to said first trigger signal;

a switch coupled to the handset, said switch being actuatable in response to movement of the handset to generate a second trigger signal; and a message selector operatively coupled to the switch and to the speaker, said message selector having a memory for storing a message, said message selector delivering said message to said speaker in response to said second trigger signals wherein said message timer comprises:

a clock circuit, said clock circuit generating a clock signal;

a random number generator generating a first random number and a second random number;

a scaler receiving said first random number, said scaler generating a timing signal correlative to said first random number;

a counter receiving said clock signal and generating a count signal correlative thereto; and a comparator receiving said timing signal and said count signal and generating said first trigger signal in response to said timing signal and said count signal being equal.

11. The toy telephone, as set forth in claim 10, wherein said message selector stores a plurality of messages and receives said second random number, said first trigger signal, and said second trigger signal, said message selector selecting one of said plurality of messages in response to said second random number, and said message selector delivering said selected one of said plurality of messages to said display in response to coincidence of said first trigger signal and said second trigger signal.

12. The toy telephone, as set forth in claim 10, further comprising:

a keypad having a plurality of actuatable keys.

13. The toy telephone, as set forth in claim 12, wherein said message selector delivers said message to said speaker in response to actuation of a selected number of said keys.

14. The toy telephone, as set forth in claim 12, further comprising:

a visual display, said visual display displaying numbers associated with the actuation of said keys.

15. A toy comprising:

means for generating a random timing signal;

means for storing a message;

means for displaying said message in response to said timing signal.

* * * * *